US009198478B2

(12) United States Patent
Meschter et al.

(10) Patent No.: US 9,198,478 B2
(45) Date of Patent: Dec. 1, 2015

(54) SUPPORT MEMBERS WITH VARIABLE VISCOSITY FLUID FOR FOOTWEAR

(71) Applicant: Nike, Inc., Beaverton, OR (US)

(72) Inventors: James C. Meschter, Portland, OR (US); Mike A. Chamblin, Portland, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 247 days.

(21) Appl. No.: 13/784,952

(22) Filed: Mar. 5, 2013

(65) Prior Publication Data

US 2014/0250726 A1 Sep. 11, 2014

(51) Int. Cl.
*A43B 13/20* (2006.01)
*A43B 13/18* (2006.01)

(52) U.S. Cl.
CPC ..... *A43B 13/20* (2013.01); *A43B 13/189* (2013.01); *A43B 13/206* (2013.01)

(58) Field of Classification Search
CPC .... A43B 1/0054; A43B 13/18; A43B 13/181; A43B 13/185; A43B 13/189; A43B 13/20; A43B 13/206; A43B 21/32; A43B 21/265; A43B 17/026; A43B 17/03
See application file for complete search history.

(56) References Cited

U.S. PATENT DOCUMENTS

| | | | | |
|---|---|---|---|---|
| 3,511,583 | A | 5/1970 | Brown | |
| 4,053,952 | A | 10/1977 | Goldstein | |
| 4,471,538 | A * | 9/1984 | Pomeranz et al. | 36/28 |
| 4,928,125 | A | 5/1990 | Iino | |
| 5,316,261 | A | 5/1994 | Stoner | |
| 6,568,102 | B1 * | 5/2003 | Healy et al. | 36/28 |
| 7,219,449 | B1 * | 5/2007 | Hoffberg et al. | 36/88 |
| 7,506,460 | B2 * | 3/2009 | DiBenedetto et al. | 36/132 |
| 7,566,209 | B2 | 7/2009 | Estes et al. | |
| 2003/0120353 | A1 * | 6/2003 | Christensen | 623/26 |
| 2004/0154190 | A1 * | 8/2004 | Munster | 36/28 |
| 2004/0177531 | A1 * | 9/2004 | DiBenedetto et al. | 36/132 |
| 2005/0172515 | A1 * | 8/2005 | Ungari | 36/88 |
| 2006/0248749 | A1 * | 11/2006 | Ellis | 36/28 |
| 2006/0248750 | A1 * | 11/2006 | Rosenberg | 36/29 |
| 2007/0000154 | A1 * | 1/2007 | DiBenedetto et al. | 36/132 |
| 2007/0011920 | A1 * | 1/2007 | DiBenedetto et al. | 36/132 |
| 2008/0016718 | A1 * | 1/2008 | Aveni et al. | 36/28 |
| 2008/0016719 | A1 * | 1/2008 | Aveni et al. | 36/28 |

(Continued)

FOREIGN PATENT DOCUMENTS

| | | |
|---|---|---|
| DE | 19725685 | 12/1998 |
| JP | 01169185 | 7/1989 |

(Continued)

OTHER PUBLICATIONS

International Search Report and Written Opinion for PCT Application No. PCT/US2014/020212 mailed Jul. 7, 2014.

(Continued)

*Primary Examiner* — Khoa Huynh
*Assistant Examiner* — Megan Brandon
(74) *Attorney, Agent, or Firm* — Plumsea Law Group, LLC

(57) ABSTRACT

An article of footwear including an adaptive support system includes a plurality of support members. Each support member includes an outer chamber and an inner chamber, the inner chamber being filled with a magnetorheological fluid. An electromagnet is disposed adjacent to the inner chamber and can be used to vary the viscosity of the magnetorheological fluid.

20 Claims, 9 Drawing Sheets

(56) References Cited

U.S. PATENT DOCUMENTS

| | | | | |
|---|---|---|---|---|
| 2008/0016720 | A1* | 1/2008 | Aveni et al. | 36/28 |
| 2008/0083140 | A1* | 4/2008 | Ellis | 36/140 |
| 2009/0100705 | A1* | 4/2009 | Cook et al. | 36/29 |
| 2009/0158622 | A1* | 6/2009 | Cook et al. | 36/137 |
| 2009/0183387 | A1* | 7/2009 | Ellis | 36/29 |
| 2010/0107444 | A1* | 5/2010 | Aveni et al. | 36/88 |
| 2010/0199519 | A1* | 8/2010 | Battlogg | 36/83 |
| 2010/0252117 | A1 | 10/2010 | Pattekar et al. | |
| 2011/0131833 | A1* | 6/2011 | Cook et al. | 36/29 |
| 2011/0175744 | A1* | 7/2011 | Englert et al. | 340/665 |
| 2012/0234111 | A1 | 9/2012 | Molyneux et al. | |
| 2013/0167402 | A1* | 7/2013 | Christensen et al. | 36/29 |
| 2013/0278435 | A1* | 10/2013 | Ellis, Frampton E. | 340/870.07 |
| 2014/0250875 | A1* | 9/2014 | Ignatchenko et al. | 60/325 |
| 2014/0259749 | A1* | 9/2014 | Taylor et al. | 36/29 |

FOREIGN PATENT DOCUMENTS

| | | |
|---|---|---|
| JP | 02026380 | 1/1990 |
| WO | 2007125148 | 11/2007 |
| WO | 2014/138020 A1 | 9/2014 |

OTHER PUBLICATIONS

International Preliminary Report on Patentability and Written Opinion of the International Searching Authority issued Sep. 8, 2015 in International Patent Application No. PCT/US2014/020212.

* cited by examiner

SUPPORT MEMBERS WITH VARIABLE VISCOSITY FLUID FOR FOOTWEAR

BACKGROUND

The present embodiments relate generally to footwear and in particular to articles of footwear having support members.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter.

The sole structure is secured to a lower portion of the upper so as to be positioned between the foot and the ground. In athletic footwear, for example, the sole structure may include a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and may be fashioned from a durable and wear-resistant rubber material that includes texturing to impart traction. The sole structure may also include a sockliner positioned within the upper and proximal a lower surface of the foot to enhance footwear comfort.

SUMMARY

In one aspect, an article of footwear includes a first support member having a first outer portion made of a compressible material and a first inner portion, where the first inner portion is filled with rheological fluid. The article of footwear also includes a second support member having a second outer portion made of a compressible material and a second inner portion, where the second inner portion is filled with rheological fluid. The article of footwear also includes a first reservoir in fluid communication with the first inner portion and a second reservoir in fluid communication with the second inner portion, a first electromagnetic device associated with the first support member, where the first electromagnetic device can be activated to vary the viscosity of the rheological fluid in the first inner portion and a second electromagnetic device associated with the second support member, where the second electromagnetic device can be activated to vary the viscosity of the rheological fluid in the second inner portion. The first support member and the second support member are spaced apart from one another.

In another aspect, an article of footwear includes a support member having an outer portion made of a compressible material and an inner portion, where the inner portion is filled with a rheological fluid. The article of footwear also includes a reservoir in fluid communication with the inner portion and an electromagnetic device associated with the support member, where the electromagnetic device can be activated to vary the viscosity of the rheological fluid in the inner portion. The outer portion has an approximately cylindrical shape and the inner portion is generally coaxial with the outer portion.

In another aspect, an article of footwear includes a support member comprising a bladder with an outer chamber and an inner chamber, where the outer chamber is sealed from the inner chamber. The outer chamber is filled with a gas and the inner chamber is filled with a rheological fluid. The article of footwear also includes a reservoir in fluid communication with the inner chamber and an electromagnetic device associated with the support member, where the electromagnetic device can be activated to vary the viscosity of the rheological fluid in the inner chamber.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
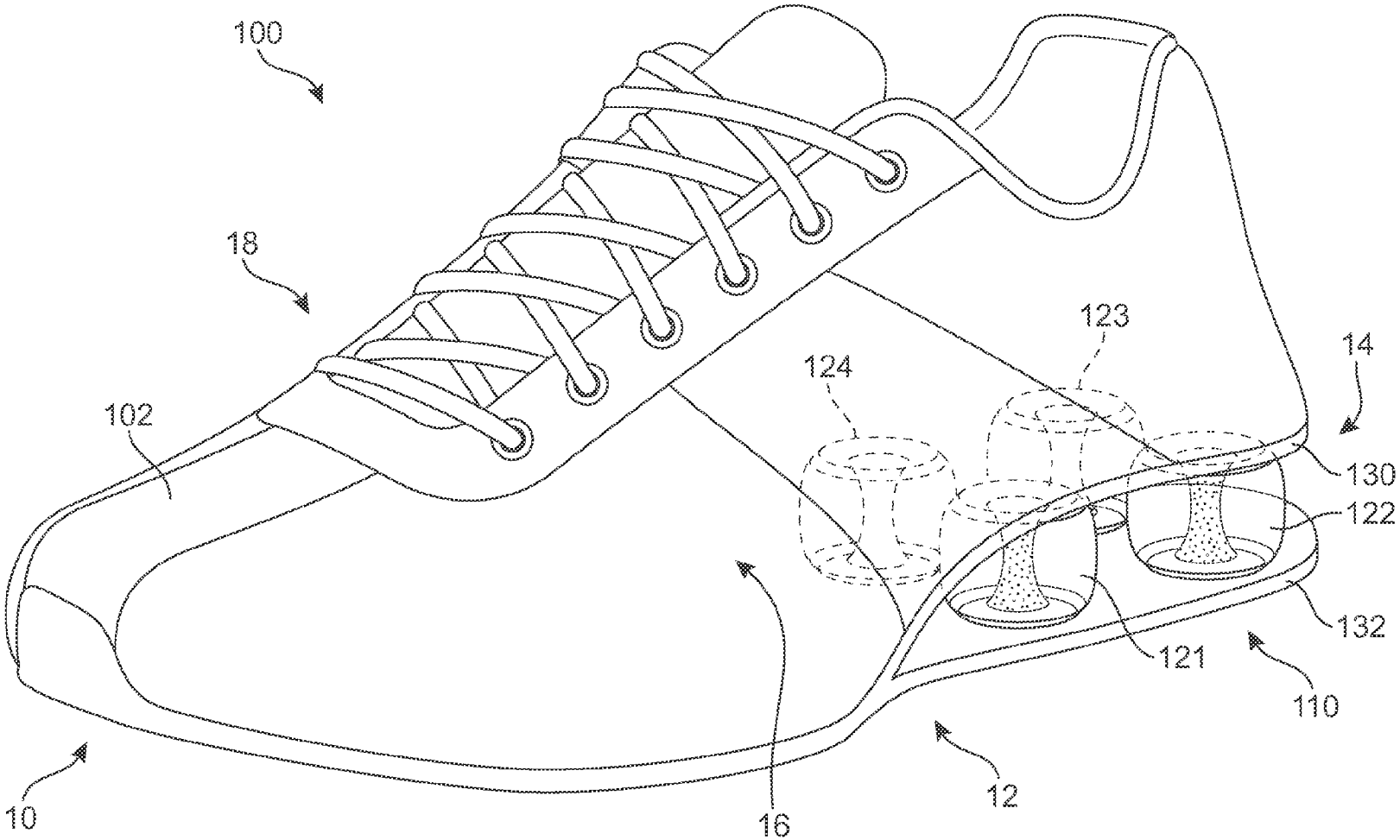
FIG. 1 is a schematic isometric view of an embodiment of an article of footwear including an adaptive support system.

FIG. 1 illustrates a schematic isometric view of an embodiment of an article of footwear 100, also referred to simply as article 100. Article 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of a component, rather than precisely demarcating article 100 into two halves.

For consistency and convenience, directional adjectives are employed throughout this detailed description corresponding to the illustrated embodiments. The term "longitudinal" as used throughout this detailed description and in the claims refers to a direction extending a length of a component. In some cases, the longitudinal direction may extend from a forefoot portion to a heel portion of the article. Also, the term "lateral" as used throughout this detailed description and in the claims refers to a direction extending a width of a component, such as an article. For example, the lateral direction may extend between a medial side and a lateral side of a last member. Furthermore, the term "vertical" as used throughout this detailed description and in the claims refers to a direction that is perpendicular to both the longitudinal and lateral directions. In situations where an article is placed on a ground surface, the upwards vertical direction may be oriented away from the ground surface, while the downwards vertical direction may be oriented towards the ground surface. It will be understood that each of these directional adjectives may be also be applied to individual components of article 100 as well.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional.

Some embodiments can include provisions for shock absorption, energy return, cushioning and/or comfort. In some embodiments, an article of footwear may be configured with an adaptive support system, which may include provisions for adaptively changing support for an article. In some embodiments, an adaptive support system can include one or more support members with variable support characteristics.

Figure 2:
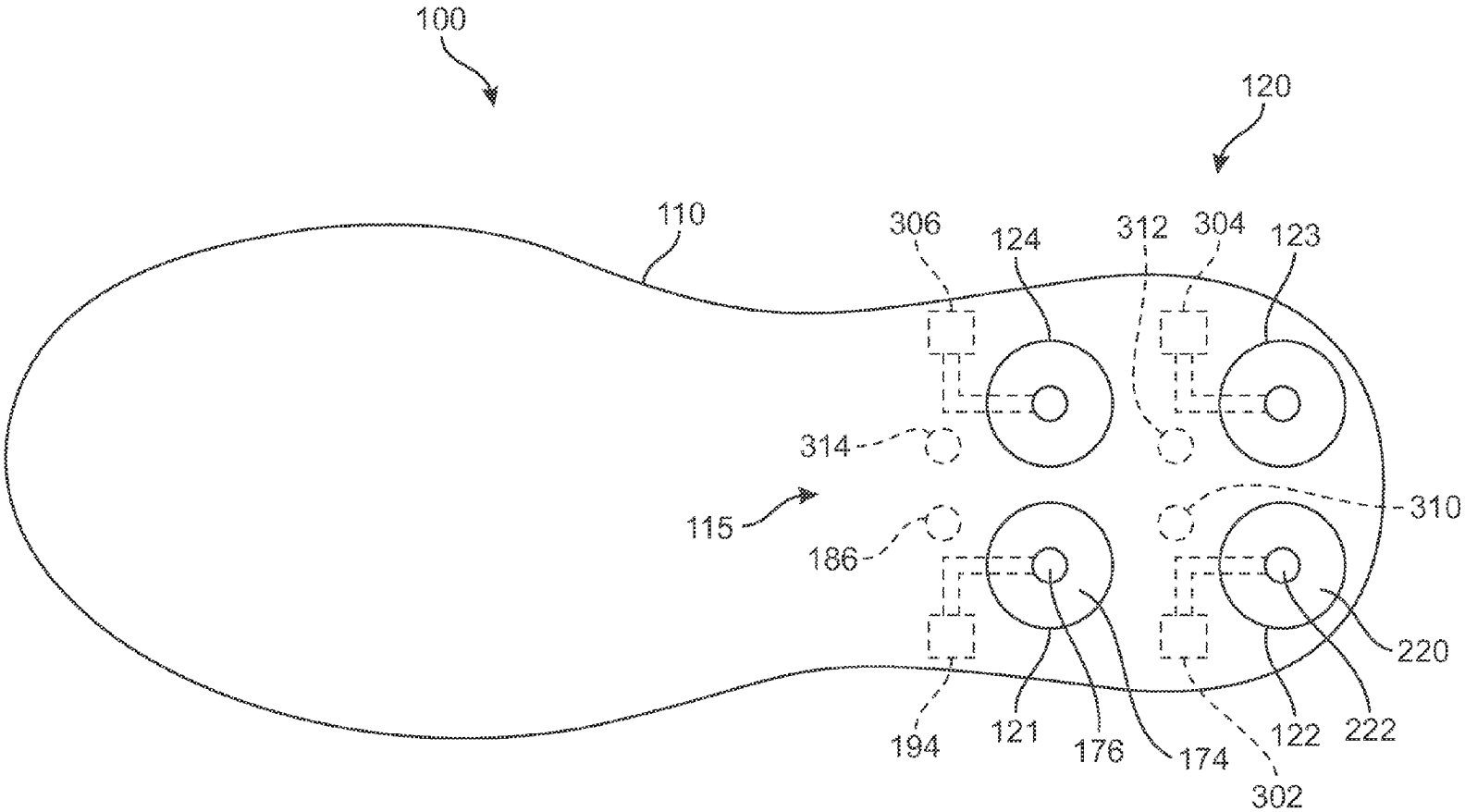
FIG. 2 is a schematic plan view of the article of FIG. 2.

FIG. 2 illustrates a schematic plan view of an embodiment of article 100 that is configured with an adaptive support system 115. In particular, some components of adaptive support system 115 may be seen in FIG. 1. Referring now to FIGS. 1 and 2, adaptive support system 115 may include one or more support members, which may facilitate shock absorption, energy return and/or cushioning, for example. In one embodiment, sole structure 110 may include plurality of support members 120 that further comprises first support member 121, second support member 122, third support member 123 and fourth support member 124.

In some embodiments, plurality of support members 120 comprise individual members that are spaced apart from one another. In particular, first support member 121, second support member 122, third support member 123 and fourth support member 124 are arranged as column-like members that extend between upper plate 130 and lower plate 132. With this arrangement, plurality of support members 120 may provide support to the heel of a foot, which is generally disposed over upper plate 130 of article 100.

Also shown in FIG. 2 are various additional components of adaptive support system 115, which are described in further detail below. It will be understood however, these components and their respective locations within article 100 are optional.

In some embodiments, one or more support members can be configured to provide adaptive support or response to forces applied to article 100 by a user's foot, a ground surface as well as possibly other sources. In some embodiments, one or more support members can be configured with adaptive shock-absorption, energy return and/or cushioning properties. In one embodiment, one or more support members can include a portion with variable shock-absorption, cushioning, rigidity and/or other properties.

Figure 3:
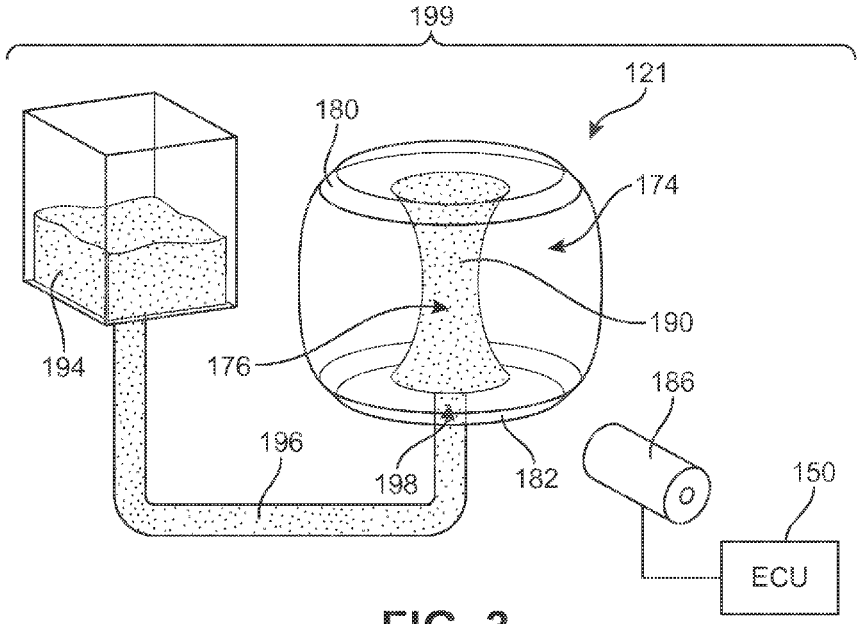
FIG. 3 is a schematic view of an embodiment of some components of an adaptive support assembly.
Figure 4:
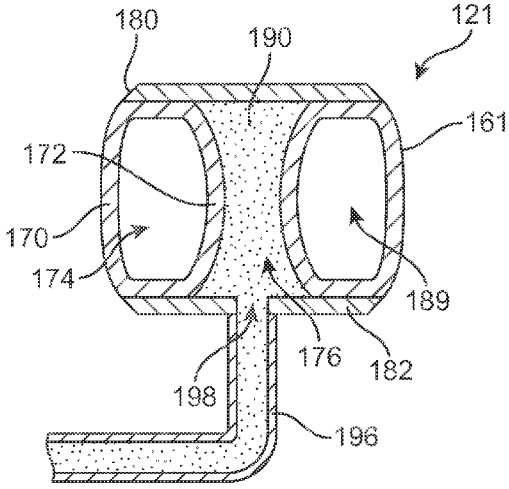
FIG. 4 is a schematic cross-sectional view of some of the components shown in FIG. 3.

FIGS. 3 and 4 illustrate an isolated view of an adaptive support assembly 199 that includes first support member 121 (also referred to simply as support member 121) as well as additional components that facilitate the operation of support member 121 in order to provide varying shock-absorption, cushioning and/or other properties for support member 121. In particular, FIG. 3 illustrates a schematic isometric view of adaptive support assembly 199, while FIG. 4 illustrates a schematic cross-sectional view of some components of adaptive support assembly 199. For purposes of clarity, many of the components of adaptive support assembly 199 are shown schematically, and it should be understood that these components could have any other shapes, sizes as well as possibly additional features in other embodiments.

Generally, as described in further detail below, a support member can be configured with an outer portion that is substantially compressible as well as an inner portion that is at least partially bounded by the outer portion. In some embodiments, whereas the outer portion may have a substantially fixed compressibility or rigidity, the compressibility or rigidity of the inner portion could be variable. In some embodiments, the variable compressibility of the inner portion can be achieved using a fluid having variable viscosity or structural characteristics. In one embodiment, the inner portion may be a cavity filled with a rheological fluid, including, for example, an electrorheological fluid or a magnetorheological fluid.

Referring to FIGS. 3 and 4, support member 121 can be configured as a bladder having an outer chamber 174 and an inner chamber 176. In some embodiments, the outer chamber 174 may be sealed from the inner chamber 176 so that no fluid can be exchanged between the outer chamber 174 and in the inner chamber 176.

Structurally, in some embodiments, support member 121 may be configured with an outer ring-like (or donut-like) member 161 surrounding a central region. The region encircled by member 161 may further be bounded above and below by an upper bladder wall 180 and a lower bladder wall 182. This arrangement creates a sealed inner chamber 176.

The upper bladder wall 180 and the lower bladder wall 182 may generally be attached to member 161 in a manner that prevents fluid from escaping between member 161 and upper bladder wall 180 and/or lower bladder wall 182. In some embodiments, upper bladder wall 180 and/or lower bladder wall 182 may be bonded to member 161 using adhesives, thermal bonding, as well as any other methods known in the art for joining layers of a bladder together. Moreover, in other embodiments, upper bladder wall 180 and/or lower bladder wall 182 could be integrally formed with member 161.

In some embodiments, first fluid 189 in the form of a gas or liquid may be sealed within the outer chamber 174, between an exterior bladder wall 170 and an interior bladder wall 172. Additionally, a second fluid 190 may fill inner chamber 176. In some embodiments, the first fluid 189 and the second fluid 190 could be substantially similar. In other embodiments, the first fluid 189 and the second fluid 190 could be substantially different. In one embodiment, the first fluid 189 may be air and the second fluid 190 may be a magnetorheological fluid. Therefore, first fluid 189 may be a substantially compressible gas, while second fluid 190 may be a substantially incompressible liquid.

Some embodiments may include provisions for allowing second fluid 190 to flow into and/or out of inner chamber 176. In some embodiments, lower bladder wall 182 may include a hole or aperture in the form of fluid port 198, which allows second fluid 190 to enter/escape from inner chamber 176. Additionally, some embodiments further include a fluid line 196 that facilitates fluid communication between fluid port 198 and a reservoir 194. Although a fluid port 198 is shown in lower bladder wall 182 in this embodiment, other embodiments could incorporate a fluid port in any other portion including, for example upper bladder wall 180.

Reservoir 194, shown schematically in the figures, may house some of the total volume of the second fluid 190, which can flow between reservoir 194 and inner chamber 176, by way of fluid line 196. It will be understood that the shape, size and structural properties of reservoir 194 may vary according to factors including, but not limited to: the total volume of second fluid 190, the volume of inner chamber 176, the volume of fluid line 196, the intended location within an article of reservoir 194, manufacturing considerations as well as possibly other factors.

Figure 5:
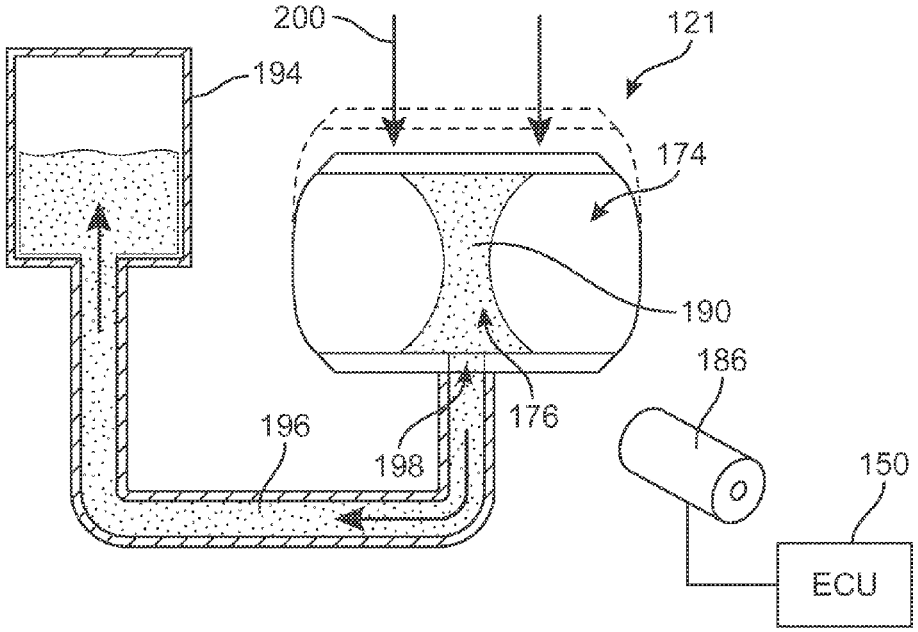
FIG. 5 is a schematic side view of an embodiment of some components of an adaptive support assembly in which a support member undergoes compression.

A possible mode of operation of adaptive support assembly 199 is shown schematically in FIG. 5. Referring now to FIG. 5, a downward force 200 applied to first support member 121 may act to compress support member 121 in the generally vertical direction. In this situation, outer chamber 174, which is filled with a compressible gas such as air, may temporarily deform or deflect under downward force 200. In addition, second fluid 190, which is generally an incompressible fluid, is pushed through fluid line 196 and into reservoir 194, thereby allowing inner chamber 176 to deform or deflect along with outer chamber 174. Furthermore, the compression of gas within outer chamber 174 stores potential kinetic energy that may cause outer chamber 174 (and with it inner chamber 176) to expand as downward force 200 is diminished and/or completely removed. This arrangement allows first support member 121 to act as a shock-absorber and to provide some energy return.

Referring back to FIGS. 3 and 4, the overall compressibility of first support member 121 is due to the combination of the material properties of the first fluid 189 in outer chamber 174 and the material properties of second fluid 190 in inner chamber 176. Because outer chamber 174 is sealed and the material properties of first fluid 189 are generally unchanged, the compressibility of outer chamber 174 is generally constant and unchanging. However, as second fluid 190 has variable material properties, including viscosity, it is possible to vary the compressibility of inner chamber 176 and therefore the overall compressibility of first support member 121.

As seen in FIG. 3, adaptive support assembly 199 may include provisions for controlling the material properties (such as viscosity) of second fluid 190. In some embodiments, assembly 199 may include an electromagnet device. Examples of electromagnetic devices include electrical devices, such as capacitors, as well as magnetic devices such as electromagnets. In some embodiments, an electromagnet device may also comprise a permanent magnet. The type of electromagnetic device used may be selected according to the material properties of second fluid 190. For example, where an electrorheological fluid is used, an electromagnetic device may be a capacitor or other electrical device capable of generating an electrical field. In cases where a magnetorheological fluid is used, the electromagnetic device may be an electromagnet.

In one embodiment, adaptive support assembly 199 may include electromagnet 186. Generally, any kind of electromagnet or electromagnetic device known in the art could be used. Moreover, the type of electromagnet used could be selected according to factors including, but not limited to: required field strength, required location within the article, durability, power requirements as well as possibly other factors.

Although shown schematically in the figures, electromagnet 186 may generally be positioned so that the required range of magnetic forces can be applied to second fluid 190. In some embodiments, electromagnet 186 can be positioned so that the magnetic field primarily interacts with the volume of second fluid 190 disposed in inner chamber 176. In other embodiments, electromagnet 186 may be positioned so that the magnetic field primarily interacts with the volume of second fluid 190 disposed in fluid line 196, especially in the vicinity of fluid port 198. In still other embodiments, electromagnet 186 may be positioned so that the magnetic field primarily interacts with the volume of second fluid 190 disposed in reservoir 194. In still further embodiments, electromagnet 186 may be positioned so that the magnetic field interacts with portions of the volume of second fluid 190 disposed within each of reservoir 194, fluid line 196 and inner chamber 176.

Electromagnet 186 may apply a magnetic field to regions of second fluid 190 that alter the material properties, including the apparent viscosity, of second fluid 190. Varying the viscosity of regions of second fluid 190 may change the rate of fluid flow between inner chamber 176 and reservoir 194. In cases where the viscosity is greatly increased at some regions of second fluid 190, the flow may be substantially stopped. As the viscosity varies in response to the magnetic field, thereby restricting or completely preventing fluid flow, the compressibility of inner chamber 176 (and thus of first support member 121) may vary accordingly. For example, if the viscosity of second fluid 190 is high enough to stop flow of second fluid 190 through fluid port 198, inner chamber 176 may remain filled with second fluid 190 and therefore unable to deform, deflect or otherwise vary in shape and/or volume. Moreover, by varying the viscosity, the rate of flow of second fluid 190 can change so that the rate of deformation or deflection, and therefore the compressibility, of inner chamber 176 can be varied accordingly.

In particular, the general incompressibility of second fluid 190 means that the compressibility of inner chamber 176 may be influenced by changes in the fluid viscosity that occur both inside and outside of inner chamber 176. Thus, it is possible to adjust the compressibility of inner chamber 176 by modifying the viscosity of second fluid 190 at any of reservoir 194, fluid line 196 and/or inner chamber 176. In one embodiment, for example, electromagnet 186 may be positioned in the vicinity of fluid port 198, so that a magnetic field generated by electromagnet 186 can change the viscosity of second fluid 190 at fluid port 198 as well as possibly within inner chamber 176. This may result in fluid port 198 being substantially closed (i.e., clogged) so that no fluid can flow from inner chamber 176.

In order to control electromagnet 186, some embodiments may further include an electronic control unit 150, hereafter referred to simply as ECU 150. ECU 150 is described in further detail below.

Although the current embodiment uses an electromagnet that is actuated by ECU 150, other embodiments could use a permanent magnet to vary the viscosity of second fluid 190. In another embodiment, a permanent magnet could be configured with a position that varies relative to regions of second fluid 190. As the permanent magnet moves closer to second fluid 190, the increased magnetic field strength increases the viscosity of second fluid 190. This could be accomplished, for example, by placing a compressible material between the magnet and the associated region of second fluid 190, so that as the compressible material is squeezed (e.g., during a ground-contact), the relative distance between the magnet and second fluid 190 decreases. In still other embodiments, a permanent magnet could be associated with an actuating member that automatically adjusts the relative position of the magnet with respect to a corresponding region of second fluid 190.

Figure 6:
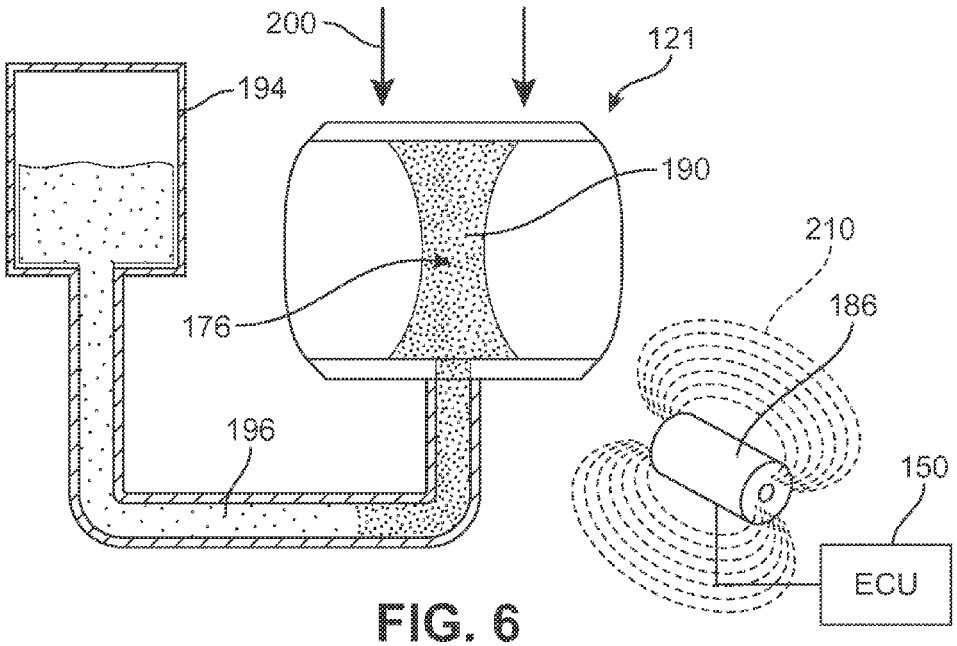
FIG. 6 is a schematic side view of an embodiment of some components of an adaptive support assembly in which the material properties of a support member are varied in response to a magnetic field.
Figure 7:
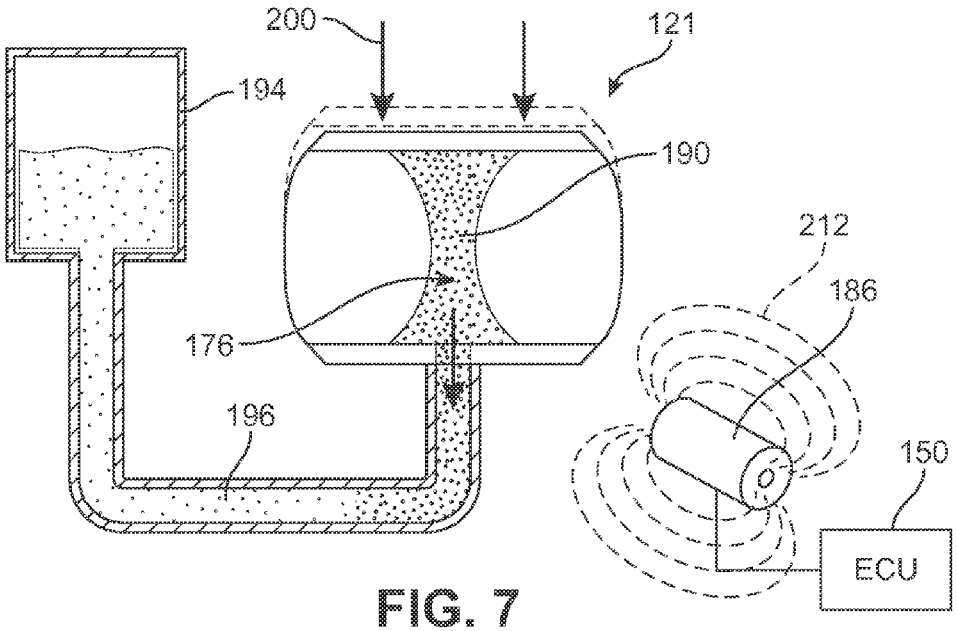
FIG. 7 is a schematic side view of an embodiment of some components of an adaptive support assembly in which the material properties of a support member are varied in response to a magnetic field.

FIGS. 6 and 7 illustrate schematic views of two additional operating modes for adaptive support assembly 199. Referring to FIG. 6, electromagnet 186 is operated with a substantially maximum magnetic field strength 210. In this mode, the viscosity of second fluid 190 within inner chamber 176 and in the portion of fluid line 196 adjacent to inner chamber 176 may be greatly increased to the point where substantially no fluid flow is possible even with the application of downward forces 200. In this highly viscous state, second fluid 190 remains trapped in inner chamber 176 and thereby prevents first support member 121 from compressing. Referring next to FIG. 7, electromagnet 186 is operated with an intermediate magnetic field strength 212 that is less than the maximum magnetic field strength 210. In this mode, the viscosity of second fluid 190 within inner chamber 176 and in the portion of fluid line 196 adjacent to inner chamber 176 may be increased to a point where fluid flow is diminished but not completely stopped. Thus, in this state, second fluid 190 can flow at a substantially reduced rate from inner chamber 176, which allows for some compression of first support member 121. However, as seen by comparing FIG. 7 with FIG. 5, with electromagnet 186 partially energized (FIG. 7), the amount of compression experienced by support member 121 is substantially less than the amount of compression experienced by support member 121 with electromagnet 186 off (FIG. 5).

Provisions for returning inner chamber 176 to a pre-compressed state may vary in different embodiments. In one embodiment, reservoir 194 may be partially filled with a compressible gas, which may compress as second fluid 190 fills reservoir 194. As downward forces 200 are diminished, the compressed gas in reservoir 194 may expand to push second fluid 190 back into inner chamber 176. In other embodiments, reservoir 194 may further include one or more actuating systems to push second fluid 190 out of reservoir 194 and into inner chamber 176 (e.g., a piston that reduces the volume of reservoir 194).

The embodiments shown in the figures and discussed here are only intended to be exemplary. Still other embodiments of an adaptive support assembly could include additional provisions for controlling the flow of second fluid 190. For example, other embodiments could include additional valves or other fluid controlling provisions to facilitate fluid flow in the desired direction and at the desired rate in response to various compressive forces.

Figure 8:
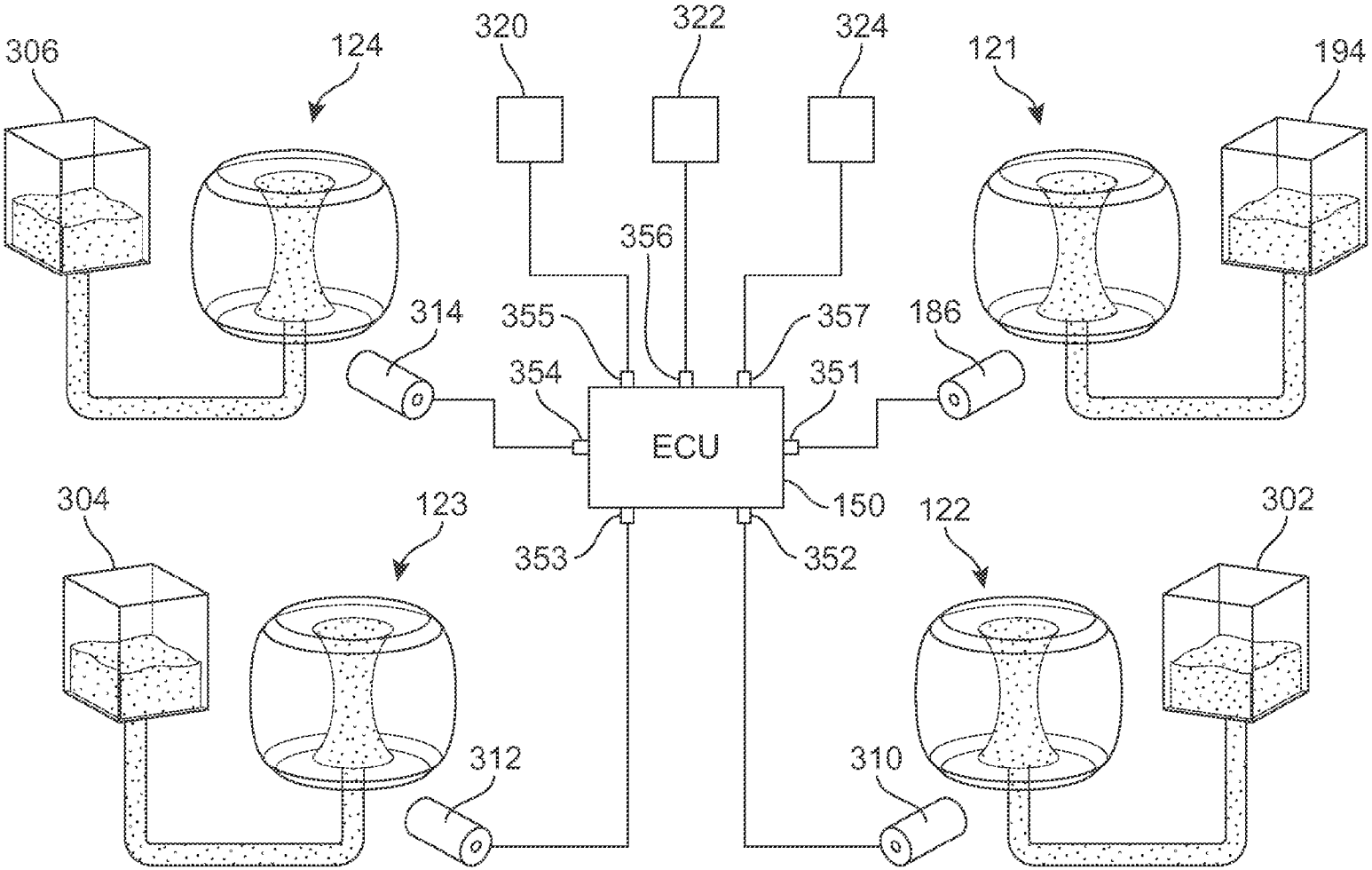
FIG. 8 is a schematic view of an embodiment some components of an adaptive support system.

FIG. 8 illustrates a schematic view of an embodiment of adaptive support system 115 that may include plurality of support members 120 as well as provisions for controlling the material properties of each support member. As previously discussed, plurality of support members 120 may include first support member 121, second support member 122, third support member 123 and fourth support member 124. Each support member can be configured with similar provisions to first support member 121 for adaptively controlling compression, shock-absorption, etc. For example, each of second support member 122, third support member 123 and fourth support member 124 may be associated with second reservoir 302, third reservoir 304 and fourth reservoir 306, respectively, as well as associated fluid lines. Likewise, each of second support member 122, third support member 123 and fourth support member 124 may be associated with second electromagnet 310, third electromagnet 312 and fourth electromagnet 314, respectively.

In some embodiments, each electromagnet may be controlled using one or more electronic control units. In one embodiment, each electromagnet can be associated with ECU 150. Still other embodiments could utilize two or more distinct control units. ECU 150 may include a microprocessor, RAM, ROM, and software all serving to monitor and control various components of adaptive support system 199, as well as other components or systems of article 100. For example, ECU 150 is capable of receiving signals from numerous sensors, devices, and systems associated with adaptive support system 199. The output of various devices is sent to ECU 150 where the device signals may be stored in an electronic storage, such as RAM. Both current and electronically stored signals may be processed by a central processing unit (CPU) in accordance with software stored in an electronic memory, such as ROM.

ECU 150 may include a number of ports that facilitate the input and output of information and power. The term "port" as used throughout this detailed description and in the claims refers to any interface or shared boundary between two conductors. In some cases, ports can facilitate the insertion and removal of conductors. Examples of these types of ports include mechanical connectors. In other cases, ports are interfaces that generally do not provide easy insertion or removal. Examples of these types of ports include soldering or electron traces on circuit boards.

All of the following ports and provisions associated with ECU 150 are optional. Some embodiments may include a given port or provision, while others may exclude it. The following description discloses many of the possible ports and provisions that can be used, however, it should be kept in mind that not every port or provision must be used or included in a given embodiment.

In some embodiments, ECU 150 may include port 351, port 352, port 353 and port 354 for communicating with first electromagnet 186, second electromagnet 310, third electromagnet 312 and fourth electromagnet 314, respectively. Furthermore, in some embodiments ECU 150 may further include port 355, port 356 and port 357 for communicating with sensor 320, sensor 322 and sensor 324, respectively. Sensor 320, sensor 322 and sensor 324 could be any sensors configured for use with footwear and/or apparel. In some embodiments, sensor 320, sensor 322 and sensor 324 may be a pressure sensor, a force or strain sensor and an accelerometer. In other embodiments, however, still other sensors could be used. Some embodiments, for example, could also include provisions for receiving GPS information via a GPS antenna. Examples of various sensors and sensor locations that can be incorporated into an article of footwear are disclosed in Molyneux et al., U.S. Patent Application Publication Number 2012/0234111, now U.S. patent application Ser. No. 13/399,786, filed Feb. 17, 2012, and titled "Footwear Having Sensor System", the entirety of which is hereby incorporated by reference.

The configuration shown here provides a system where each support member can be independently actuated through instructions from ECU 150. In particular, this arrangement allows the material properties of each support member (i.e., the viscosity of an enclosed magnetorheological fluid) to be independently varied in response to various sensed information including acceleration information, angle or rotation information, speed information, vertical height information, pressure information as well as other kinds of information. This allows an article of footwear to adaptively respond to a variety of different situations with the proper type and amount of shock-absorption, cushioning, energy return and comfort.

Figure 9:
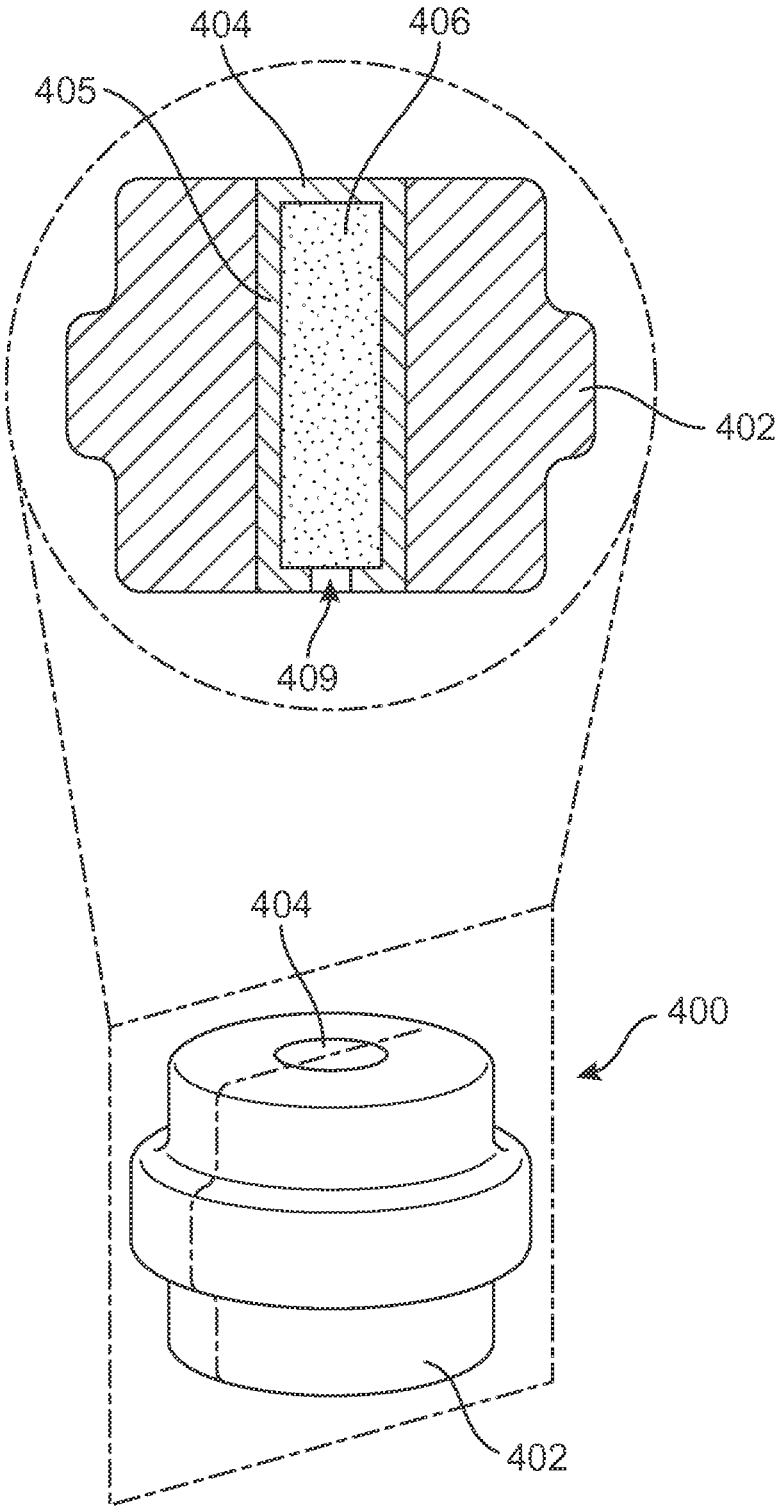
FIG. 9 is an isometric view including an enlarged cross-section of another embodiment of a support member.

FIG. 9 illustrates another possible embodiment of a support member 400 configured to have variable material properties. Referring to FIG. 9, support member 400 includes an outer portion 402 comprising a substantially compressible material as well as an inner portion 404. In some embodiments, inner portion 404 may be comprise an outer barrier layer 405 that encloses a fluid 406.

In some embodiments, fluid 406 is a variable viscosity fluid, such as an electrorheological or magnetorheological fluid. As with the previous embodiments, the viscosity of fluid 406 may vary in response to an applied magnetic field. Furthermore, though not shown here, layer 405 may include a fluid port 409 that provides fluid communication between inner portion 404 and an external reservoir of some kind. This arrangement allows fluid 406 to flow into and out of inner portion 404 in a similar manner to the flow of second fluid 190 into and out of inner chamber 176 (see FIG. 5).

In some embodiments, outer portion 402 comprises a substantially solid material, rather than a gas filled bladder. Examples of solid compressible materials that could be used include, but are not limited to: foams, compressible plastics as well as possibly other materials. The type of material used for outer portion 402 may be selected according to factors including, but not limited to: manufacturing constraints, desired compressibility, durability, weight, as well as possibly other factors. In still other embodiments, however, outer portion 402 may comprise a bladder, such as member 161 of the previous embodiments.

Referring back to FIG. 2, one possible arrangement of components of adaptive support system 115 within article 100 is shown schematically. In this case, first support member 121, second support member 122, third support member 123 and fourth support member 124 are each configured with respective outer portions and inner portions. For example, first support member 121 includes an outer portion including outer chamber 174 and an inner portion including inner chamber 176. Likewise, as another example, second support member 122 includes an outer portion including an outer chamber 220 and an inner portion including an inner chamber 222. Each of these inner portions have inner chambers filled with a magnetorheological fluid. Moreover, as previously discussed, each support member is in fluid communication with a fluid reservoir, including first reservoir 194, second reservoir 302, third reservoir 304 and fourth reservoir 306. Each reservoir can be disposed in any region of article 100. In some cases, each reservoir could be mounted to portions of sole structure 110. In other cases, each reservoir could be mounted to portions of upper 102 (not shown). In still other cases, each reservoir could be positioned and mounted in any other portions or locations of article 100.

Furthermore, each of the support members includes an electromagnet positioned adjacent to the corresponding support member, including first electromagnet 186, second electromagnet 310, third electromagnet 312 and fourth electromagnet 314. The electromagnets could be disposed in any portion of article 100 including sole structure 110 and/or upper 102.

As seen in FIG. 2, first support member 121, second support member 122, third support member 123 and fourth support member 124 are generally spaced apart so as to facilitate support over different portions of sole structure 110. This spacing facilitates differentiated shock absorption, and may allow for various configurations in which some support members are operated in different operating states or modes than other support members. Such a configuration may occur, for example, during banking.

Figure 10:
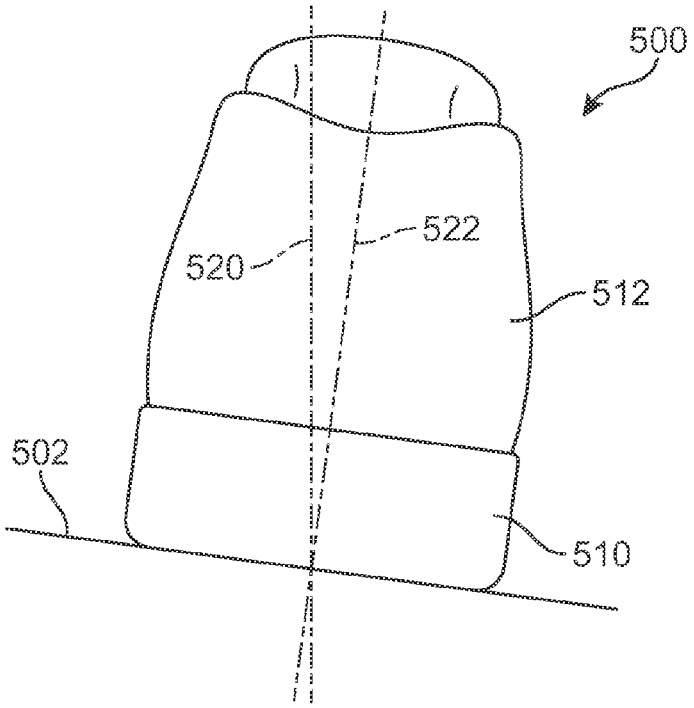
FIG. 10 is a schematic view of an embodiment of an article of footwear on a banked surface.

FIG. 10 illustrates another embodiment of an article 500 that is banked on a ground surface 502. Article 500 includes an upper 512 and a sole structure 510. Here, the vertical direction is indicated by axis 520, while the direction normal to ground surface 502 is indicated by axis 522. As seen in FIG. 10, both upper 512 and sole structure 510 are oriented along axis 522. In other words, both upper 512 and sole structure 510 are oriented, or tilted, at an angle from the true vertical direction.

Figure 11:
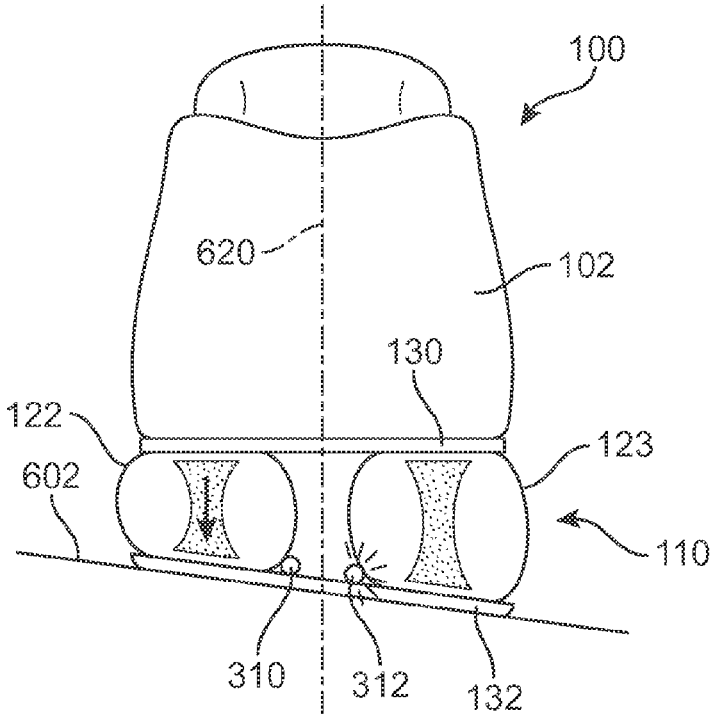
FIG. 11 is a schematic view of an embodiment of an article of footwear with support members that adaptively respond to contact with a banked surface.

FIG. 11 illustrates an embodiment of article 100 banked on a similarly inclined ground surface 602, which shows how article 100 may adaptively respond to changes in surface characteristics (such as surface orientation, angle or shape). Here, the vertical direction is indicated by axis 620. Here, lower plate 132 of sole structure 110 is sloped along with ground surface 602. However, in this embodiment, electromagnet 312 has been activated in order to change the viscosity of the magnetorheological fluid within third support member 123, thereby preventing full compression of third support member 123. In some embodiments, this activation of electromagnet 312 may occur in response to sensed information, such as information sensed from an accelerometer and/or gyroscope. In contrast, second support member 122, experiencing no magnetic forces from electromagnet 310, is compressed to a greater degree than third support member 123. This variation in compression allows upper plate 130 of sole structure 110 to remain in a generally horizontal position so that both upper plate 130 and upper 102 remain approximately aligned with vertical axis 620. Thus, adaptive support system 199 allows upper 102 to remain generally upright without any leaning or tilting that might otherwise occur during banking. This may help improve stability and balance for a user when moving along banked or uneven surfaces.

Figure 12:
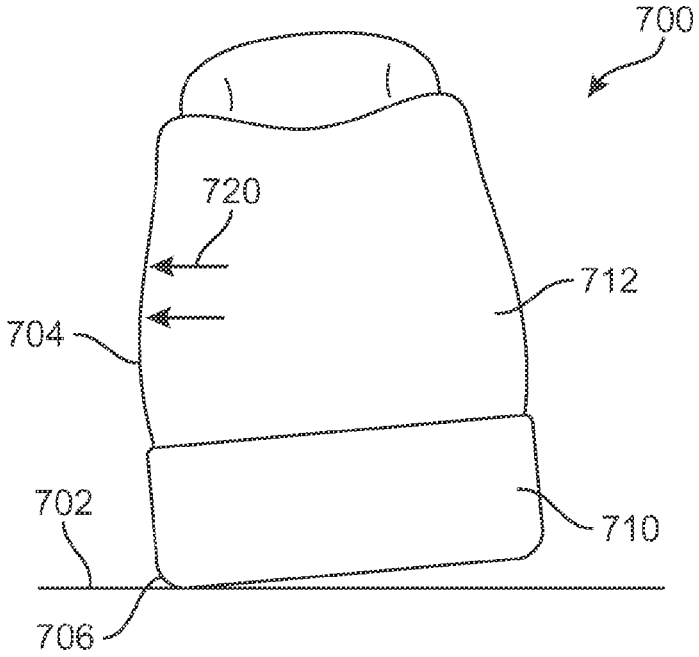
FIG. 12 is a schematic view of an embodiment of an article of footwear undergoing banking.
Figure 13:
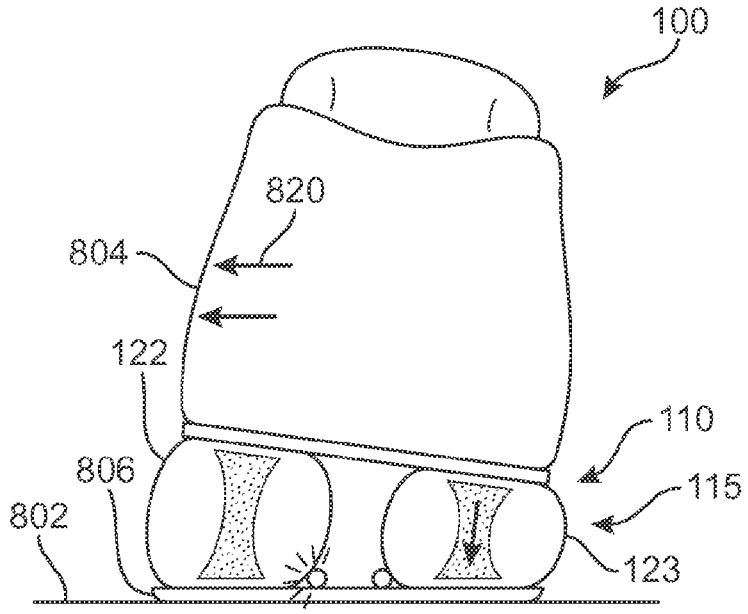
FIG. 13 is a schematic view of an embodiment of an article of footwear undergoing banking, where the support members adaptively respond to the banking.

FIGS. 12 and 13 illustrate views of footwear undergoing banking on a flat surface, which may occur as a user cuts or makes similar lateral movements (for example, on a track or basketball court). FIG. 12 shows article of footwear 700 as a user makes a lateral cut on a substantially flat ground surface 702. Article 700 includes an upper 712 and a sole structure 710. As the user cuts, the foot tends to push against the outer lateral sidewall 704 (indicated schematically as forces 720). This may tend to cause article 700 to roll or tilt about lower lateral periphery 706.

FIG. 13 illustrates an embodiment of article of footwear 100 in which a user is making a lateral cut. Moreover, FIG. 13 illustrates how article of footwear 100 may adaptively respond to various kinds of motions such as cutting or lateral motions to help improve stability during these motions. As in FIG. 12, during this cutting motion the foot tends to push against the outer lateral sidewall 804 (indicated schematically as forces 820). However, in this case adaptive support system 115 responds to this shift in weight by allowing third support member 123 to compress substantially more than second support member 122. This results in a wedge-like configuration for sole structure 110 that resists the tendency of article 100 to roll in the lateral direction about the lower lateral periphery 806 and thereby helps to improve stability. Moreover, as the weight distribution continues to change during the lateral movement (or during a sequence of lateral movements) as well as in transitions to other kind of movements, adaptive support system 115 may continue to adjust the compression characteristics of each support member accordingly.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

an upper and a sole structure;

wherein at least a portion of the sole structure includes an adaptive support system disposed between an upper plate and a lower plate;

wherein the adaptive support system comprises:

a first support member having a first outer portion filled with a compressible material and a first inner portion, wherein the first inner portion is filled with rheological fluid separated from the compressible material by a wall;

a second support member having a second outer portion filled with a compressible material and a second inner portion, wherein the second inner portion is filled with rheological fluid separated from the compressible material by a wall;

a first reservoir in fluid communication with the first inner portion and a second reservoir in fluid communication with the second inner portion, wherein the first reservoir is spaced apart from the first support member and the second reservoir is spaced apart from the second support member;

a first electromagnetic device associated with the first support member, wherein the first electromagnetic device can be activated by an electronic control unit to vary the viscosity of the rheological fluid in the first inner portion;

a second electromagnetic device associated with the second support member, wherein the second electromagnetic device can be activated by the electronic control unit to vary the viscosity of the rheological fluid in the second inner portion; and wherein the first support member and the second support member are spaced apart from one another.

2. The article of footwear according to claim 1, wherein the rheological fluid in the first inner portion and the second inner portion is an electrorheological fluid.

3. The article of footwear according to claim 1, wherein the rheological fluid in the first inner portion and the second inner portion is a magnetorheological fluid.

4. The article of footwear according to claim 3, wherein the first electromagnetic device is an electromagnet.

5. The article of footwear according to claim 1, wherein the compressibility of the first inner portion varies as the viscosity of the rheological fluid in the first inner portion is varied.

6. The article of footwear according to claim 5, wherein the compressibility of the second inner portion varies as the viscosity of the rheological fluid in the second inner portion is varied.

7. The article of footwear according to claim 6, wherein the viscosity of the rheological fluid in the first inner portion can be varied independently of the viscosity of the rheological fluid in the second inner portion.

8. An article of footwear, comprising:

an upper and a sole structure;

wherein the sole structure includes a support member having an outer portion filled with a compressible material and an inner portion, wherein the inner portion is filled with a rheological fluid separated from the compressible material by a wall;

a reservoir in fluid communication with the inner portion, wherein the rheological fluid flows between the reservoir and the inner portion through a fluid line;

an electromagnetic device positioned apart from the support member, wherein the electromagnetic device can be activated by an electronic control unit to vary the viscosity of the rheological fluid in the inner portion;

wherein the outer portion has an approximately cylindrical shape; and wherein the inner portion is generally coaxial with the outer portion.

9. The article of footwear according to claim 8, wherein the inner portion has an approximately cylindrical shape.

10. The article of footwear according to claim 8, wherein the rheological fluid is a magnetorheological fluid.

11. The article of footwear according to claim 8, wherein the outer portion is solid material.

12. The article of footwear according to claim 8, wherein the outer portion comprises an outer chamber of the support member.

13. The article of footwear according to claim 12, wherein the inner portion comprises an inner chamber of the support member.

14. An article of footwear, comprising:

an upper and a sole structure;

at least a portion of the sole structure comprises:

a support member comprising a bladder with an outer chamber and an inner chamber, wherein the outer chamber has an exterior wall and an interior wall, the outer chamber is sealed from the inner chamber by the interior wall;

the outer chamber being filled with a gas and the inner chamber being filled with a rheological fluid, wherein the gas is sealed within the outer chamber between the exterior wall and the interior wall;

a reservoir in fluid communication with the inner chamber, wherein the reservoir is spaced apart from the support member; and an electromagnetic device positioned adjacent the support member, wherein the electromagnetic device can be activated by an electronic control unit to vary the viscosity of the rheological fluid in the inner chamber.

15. The article of footwear according to claim 14, wherein the outer chamber has a ring-like geometry.

16. The article of footwear according to claim 15, wherein the support member includes an upper bladder wall and a lower bladder wall that are joined to the outer chamber and wherein the upper bladder wall, the lower bladder wall and the outer chamber bound the inner chamber.

17. The article of footwear according to claim 16, wherein the lower bladder wall includes a fluid port.

18. The article of footwear according to claim 17, wherein the electromagnetic device is disposed adjacent to the fluid port.

19. The article of footwear according to claim 14, wherein the gas is substantially compressible and wherein the rheological fluid is substantially incompressible.

20. The article of footwear according to claim 14, wherein the support member has a column-like geometry.

* * * * *